US006646566B1

(12) United States Patent
Tanguay

(10) Patent No.: US 6,646,566 B1
(45) Date of Patent: Nov. 11, 2003

(54) ENHANCED VISUAL AND AUDIBLE SIGNALING FOR SENSED ALARM CONDITION

(75) Inventor: William P. Tanguay, Downers Grove, IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 10/069,708

(22) PCT Filed: May 23, 2000

(86) PCT No.: PCT/US00/14258

§ 371 (c)(1),
(2), (4) Date: May 22, 2002

(87) PCT Pub. No.: WO00/72284

PCT Pub. Date: Nov. 30, 2000

Related U.S. Application Data

(60) Provisional application No. 60/135,877, filed on May 25, 1999.

(51) Int. Cl.[7] ..... G08B 5/00

(52) U.S. Cl. ..... 340/815.4; 340/628; 340/515.45; 340/636.1; 340/384.1; 340/815.69

(58) Field of Search ..... 340/628, 629, 340/630, 632, 636.1, 815.4, 815.45, 384.1, 384.7, 384.71, 815.69

(56) References Cited

U.S. PATENT DOCUMENTS

| | | | | |
|---|---|---|---|---|
| 4,622,544 A | | 11/1986 | Bially et al. | |
| 5,154,504 A | | 10/1992 | Helal et al. | |
| 5,668,531 A | | 9/1997 | Sukegawa et al. | |
| 5,933,078 A | | 8/1999 | O'Donnell | |
| 5,966,079 A | * | 10/1999 | Tanguay | 340/636 |
| 5,969,600 A | | 10/1999 | Tanguay | |

* cited by examiner

*Primary Examiner*—Julie Lieu
(74) *Attorney, Agent, or Firm*—Moore and Van Allen PLLC; Dominic J. Chiantera

(57) ABSTRACT

A sensor alarm which provides an alarm notification of a dangerous condition within a monitored space, further provides notice of its current state condition, from among several states, with distinct message comprising a combination of encoded audible and visible mnemonics annunciations.

35 Claims, 6 Drawing Sheets

ENHANCED VISUAL AND AUDIBLE SIGNALING FOR SENSED ALARM CONDITION

CROSS REFERENCE TO RELATED APPLICATIONS

This application claims the benefit of the filing date of the commonly owned, copending U.S. provisional patent application entitled Enhanced Visual and Audible Signaling for Smoke Alarm Condition, Ser. No. 60/135,877, filed May 25, 1999 by William P. Tanguay.

In addition, some of the material disclosed and claimed in this application is also disclosed in a commonly owned, copending utility application entitled Multi-station Dangerous Condition Alarm System Incorporating Alarm and Chirp Origination Feature, Ser. No. 09/318,698, filed May 25, 1999 by T. J. O'Donnell.

TECHNICAL FIELD

This invention relates to the field of safety alarms, and more particularly to alarms for detecting the presence of a dangerous condition in a monitored space.

BACKGROUND ART

As known, there are several different types of safety type alarms, including smoke alarms, heat alarms, and carbon monoxide detector alarms. While each of these differ in the alarm condition they detect, they all perform common alarm signaling protocols to give notice of the detected condition. The alarm notice is provided locally to warn occupants within or near the space, and may be provided to a remote monitoring location by electronic communication. To ensure adequate local notice to those in or near the monitored space, the local alarm is provided with audible and visible annunciation, using horns and lamps. Depending on the type condition being detected, the alarm protocols differ in their excitation pattern and frequency. They may also differ in their audible tones and in the intensity of their visible warning.

In locations where there are more than one installed alarm, such as in a multi-room residence where alarms may be installed in each of several floors, as well as in each of several spaces on a floor, it is well known to functionally interconnect the smoke alarms in a network to allow all units to annunciate an alarm condition detected by any one of the networked units. This provides broadcast notice of the alarm to every occupant, no matter where they are within the residence or building. One characteristic of this networked arrangement, however, is that it is not possible to determine which of the interconnected units detected the condition and originated the alarm after the alarm condition has concluded. It is advantageous to know which of several units is the originating unit, especially in the event of a false alarm condition, where it is desirable to replace only the defective unit, which will minimize replacement unit cost and needless time spent for the services of a contractor or electrician. Without an ability to determine which of the units originated the false alarm, all units must be replaced.

U.S. Pat. No. 5,933,078, by T. J. O'Donnell, issued Aug. 3, 1999, solved this problem for common residential applications by providing a smoke alarm unit that latches the unit's visual alarm annunciator in the "on", or illuminated state, whenever the unit detects an alarm condition. This occurs only within the unit which detects the alarm condition. All of the other networked units annunciate the alarm, but when the alarm condition is cleared only the originating unit continues to display a visible alarm state. This allows for immediate identification of the alarm originating unit within the network, and for its replacement in the event of a false alarm.

One problem with this self identifying unit is that the visual indicator is constantly lighted in this latched state. Ideally, the building occupant would notice this signal in a relatively timely manner, but oftentimes the condition of smoke alarms, unless sounding their audible alarm, go unnoticed. Since this condition is capable of accelerating the discharge of the battery of a battery powered unit, or the back-up battery of AC/DC model smoke alarms which use the back-up battery to power the visual indicator, its use may be limited to smoke alarms which are AC powered. To broaden the use of this feature to battery powered smoke alarms it is necessary to develop a method of providing the origination function in a manner which decreases the service life of the battery by only a small amount.

DISCLOSURE OF INVENTION

The object of the present invention is to provide improved methods and apparatus for displaying the alarm origination feature in a smoke alarm, in a manner which minimizes the load current drawn from the smoke alarm power source. Another object of the present invention is to provide improved visual notice of an alarm origination condition to an observer. Still another object of the present invention is to provide a useful and non-ambiguous hybrid signal when a combination of notice of alarm origination and low-battery signal is present.

According to one aspect of the present invention, the visual annunciation of an alarm origination condition is provided by pulsed modulation of the visual annunciator, to produce an intermittent pattern of lighted pulses. In further accord with this aspect of the present invention, the pulsed width excitation of the visual annunciator is at an average duty cycle which is no greater than approximately 0.075%. In still further accord with this aspect of the invention, the pulsed width excitation of the visual annunciator is at an average duty cycle which is no less than approximately 0.025%.

According to another aspect of the present invention, the visual pattern for notification of an alarm origination was chosen to broadly emulate the sequence of three pulses of periodicity of the audible temporal pattern specified by the Underwriter's Laboratories Standard UL217 for alarm annunciation, thereby providing improved recognition of the pulsed visual alarm origination condition on the basis of its association with the pattern of the audible annunciation of an actual alarm condition.

In accordance with a still further aspect of the present invention, a low battery annunciation is provided as one of a plurality of prioritized state conditions of the sensor alarm, with the low battery annunciation being encoded with a distinct code which allows it to be readily distinguishable from the other state condition alarms of the sensor alarm.

In the sensor alarm of the present invention a hybrid signaling condition is defined whereby the visual indicator (LED) uses three sequential flashes to show an alarm origination condition, and the audible indicator (the horn) "chirps" (if enabled) approximately once per minute to declare a low-battery condition. Upon relief of either condition, the smoke alarm's integrated circuit (IC) functional specification requires that the particular indicators return to their independent state (either only low-battery condition or only post-alarm condition).

These and other objects, features, and advantages of the present invention will become more apparent in light of the following detailed description of a best mode embodiment thereof, as illustrated in the accompanying Drawing.

BEST MODE FOR CARRYING OUT THE INVENTION

Figure 1:
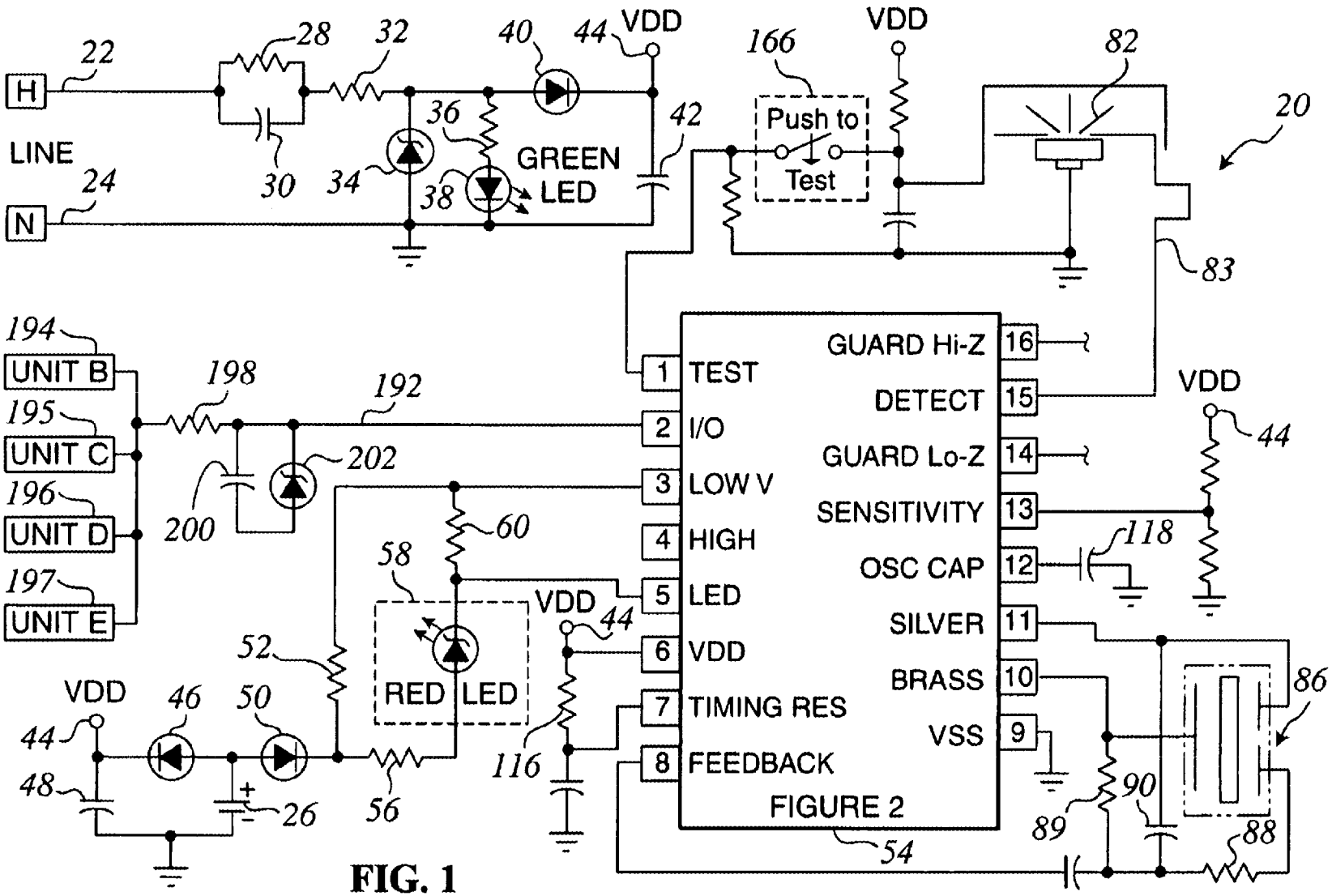
FIG. 1, is a schematic diagram of a best mode embodiment of an alarm sensor according to the present invention.

FIG. 1 is a schematic diagram of an exemplary embodiment of an alarm sensor 20 according to the present invention. In a best mode embodiment the sensor 20 has dual electrical power sources, including alternating current (AC) power received on lines 22, 24 (marked as the high [H] and neutral [N] inputs in FIG. 1), as well as a direct current (DC) battery 26. The battery is nominally 9.0 VDC, and in the dual power embodiment it functions as an emergency, or back-up source of power in the event of the loss or failure of the AC signal on lines 22, 24.

The high side of the AC signal on line 22 is coupled through a reactive power supply, comprising parallel combination of resistor 28 and capacitor 30, and through current limiting resistor 32 to zener diode 34. In its reverse biased state the zener diode 34 limits the peak amplitude of the rectified AC signal to approximately 10, and in its forward biased state the AC signal amplitude is less than one volt. This produces a half wave rectified signal, which is applied across the series combination of resistor 36 and light emitting diode (LED) 38. The LED 38, which is a known type, such as the model LTL307G light emitting diode (a conventional green color T-1¾ LED) manufactured by Liteon Optoelectronics, is thereby illuminated to visually annunciate the presence of AC power to the sensor. The half wave rectified signal is also presented through steering diode 40 to the capacitor 42 at node 44. The capacitor 42 filters the ripple component of the half-wave rectified reference signal at node 44 to provide the direct current (DC) reference value VDD.

The battery 26 is connected through the anode to cathode of steering diode 46 to node 44 and to capacitor 48. The diode prevents the rectified AC signal source for VDD from inadvertently charging the battery, but in the event of the loss of AC power the diode becomes forward biased and allows the battery to supply the VDD source signal to the sensor and circuitry.

The battery 26 is also connected through steering diode 50 and voltage divider resistor 52 to the "LOW V" input (pin 3) of an application specific integrated circuit (ASIC) 54. The "LOW V" input (pin 3) of ASIC 54 is connected through the bottom leg of voltage divider resistor 60 to the "LED" input pin 5 of ASIC 54. The battery is also connected through diode 50 to the series combination of resistor 56 and light emitting diode (LED) 58. The LED 58 is also a known type, such as the Liteon Optoelectronics LTL307 R, a conventional red color T-1¾ LED.

The other side of the LED 58 is connected to the "LED" control pin 5 of the ASIC 54. As known, an ASIC is a custom designed "Application Specific Integrated Circuit" which incorporates several unambiguous functions, thereby reducing the number of required discrete circuit elements, and conserving circuit board area. In the best mode embodiment the ASIC 54 is manufactured and sold by the model A5363 by ALLEGRO Semiconductor, Inc., 115 Northeast Cutoff, Worcester, Mass., 01615. The ASIC 54 is described in greater detail in the circuit diagram of FIG. 2, which is correlated with the ASIC block diagram of FIG. 1 by the I/O pin numbers and accompanying descriptive labels.

Figure 2:
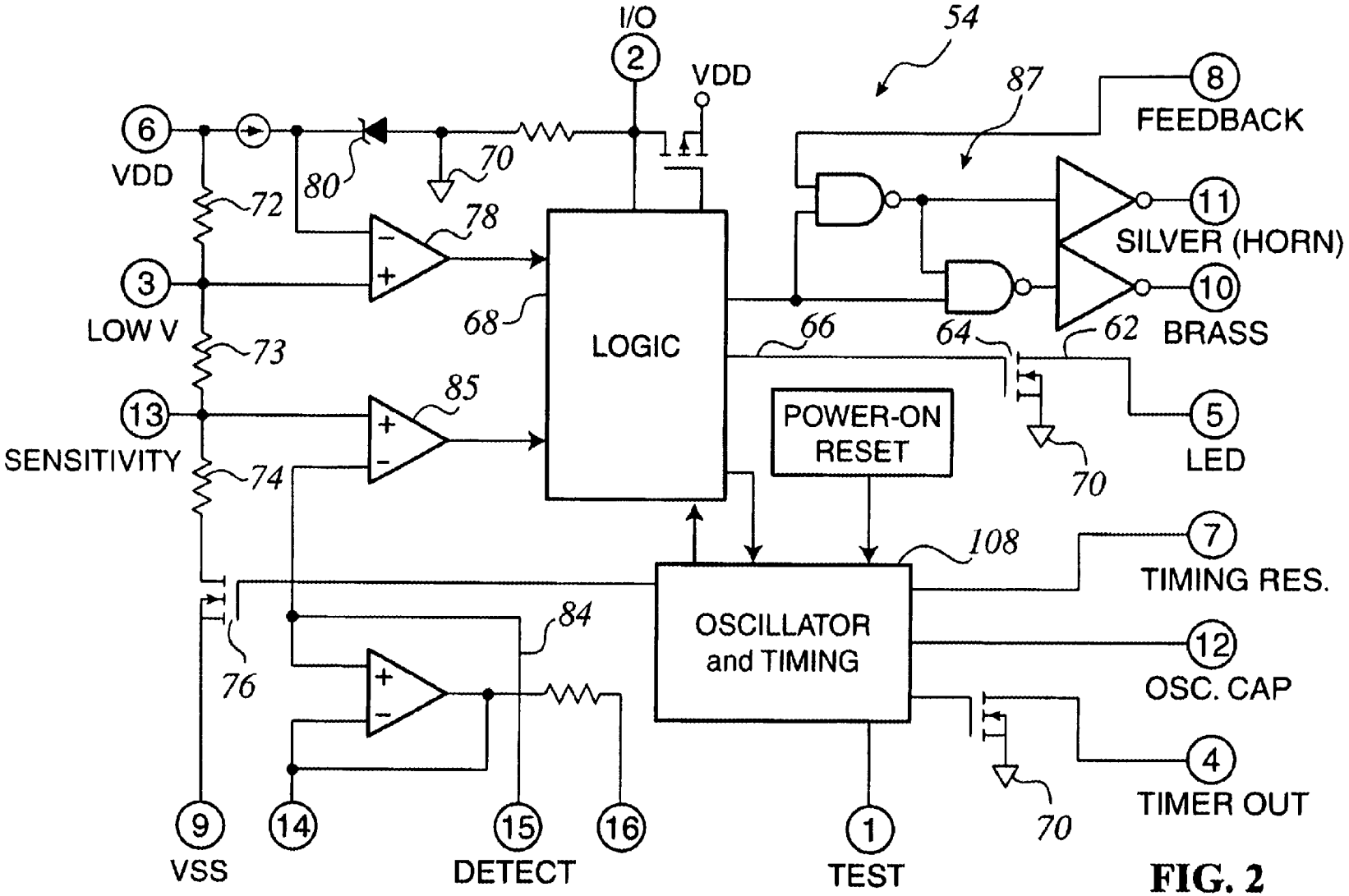
FIG. 2, is a schematic diagram of one element of the embodiment of FIG. 1.

Referring now to FIG. 2, the LED 58 connected at pin 5 of the ASIC 54 is connected within the ASIC, through a line 62 to a field effect transistor (FET) 64. When the FET 64 is turned on by a gate signal applied on line 66 from logic circuitry 68, it provides a current path for the LED 58 from pin 5 (LED) to signal ground 70, thereby allowing the LED to be energized by battery current in a Low Battery Visual Annunciator Pattern established by the logic circuitry, as described in detail hereinafter with respect to FIG. 5. The LOW V (low battery) pin 3 of the ASIC 54 is connected to a voltage divider within the ASIC, in addition to the external voltage divider comprising resistors 52 and 60 detailed in FIG. 1. This internal divider includes resistors 72–74 which are serially connected through an FET switch 76 between the VDD pin 6 and the VSS pin 9, which in the embodiment of FIG. 1 is connected to signal ground.

With a normal VDD level of approximately 9 VDC the internal resistor divider provides a nominal threshold voltage at the LOW V pin 3 of approximately 73% VDD, or slightly greater than 6.6 VDC. When the power supply voltage VDD of the smoke alarm circuit falls to approximately 7.5 VDC, the threshold of the LOW V pin 3 becomes equal to the internal reference of 5.5 VDC, and the low-voltage function of the ASIC 54 is enabled. In the disclosed circuit, the external voltage divider resistors are used to modify the actual nominal threshold voltage of pin 3 to obtain a low-voltage value moderately different than set by the ASIC manufacturer. This threshold voltage is applied to the non-inverting (+) input of comparator 78, which compares this threshold value to a reference value of approximately 5.5 VDC applied to its inverting (−) input from internal reference zener diode 80.

In the event AC power is lost, the VDD source voltage is provided by the battery 26. A drop in the battery voltage with time and current load will result in a corresponding drop of the threshold voltage at pin 3. When this threshold value drops below the internal approximately 5.5 VDC reference, as described earlier, the comparator 78 changes states and activates the Low Battery Visual Annunciator Pattern established by the logic circuitry 68. The logic circuitry replicates the Low Battery Visual Annunciator Pattern in a modulated gate signal which it provides on line 66 to sequence the actuation of the FET 64 according to the protocol of the Pattern.

Referring simultaneously to FIGS. 1 and 2, in the disclosed embodiment of the present alarm sensor 20 as a smoke alarm, smoke detection is provided by a well-known ionization detector 82 (FIG. 1) which reports a detected condition on line 83 to the DETECT pin 15 input to the ASIC 54. The ASIC provides a high-impedance non-inverting buffer to the detect input on line 83, which is connected to smoke comparator 85. In FIG. 2 the detected condition is provided through line 84 to the inverting (–) input of comparator 85, the non-inverting (+) input of which is connected to the SENSITIVITY input, pin 13 of the ASIC, which is at the junction of resistors 73, 74 of the series resistor combination 72–74.

The resistor combination provides a SENSITIVITY threshold voltage having a nominal value of approximately 50% of VDD at pin 13. In the disclosed application, external voltage divider resistors shown in FIG. 1 are used to modify the sensitivity threshold voltage to a value slightly different than 50% VDD, as required for calibration of the smoke sensing threshold. The presence of a predetermined smoke level in the ionization chamber 82 causes the output voltage at line 83 to drop a predetermined amount. The detector sensed alarm condition signal at the DETECT input is lower in magnitude than the SENSITIVITY threshold value, causing the comparator 85 to change states and activate the Audible and Visual Alarm Annunciator pattern established by the logic circuitry 68.

Under an alarm condition, the logic circuitry 68 actuates the audible and visual alarms concurrently. In the best mode embodiment, the audible annunciation is provided by a piezoelectric horn 86 (FIG. 1) which is actuated by horn driver circuitry within the ASIC 54. The horn driver circuitry within the ASIC is shown generally at 87 in FIG. 2. The piezoelectric horn is a thin disk of piezoelectric ceramic material bonded to a slightly larger diameter of stainless steel disk. The piezoceramic disc has two discrete electrodes, generally of silver, that are screened onto its surface. One larger electrode, commonly referred to as the "silver" electrode, is connected to pin 11 of the ASIC 54. The second electrode is the actual stainless steel disk, commonly called "brass" because of a historical reference to the original disk material, connected to pin 10 of the ASIC 54. A second and smaller silver electrode, commonly referred to as the "feedback" electrode, is connected to pin 8 of ASIC 54.

When enabled by the logic elements of ASIC 54, internal NAND gates of horn driver 90, in conjunction with output inverters shown connected to ASIC 54 pins 10 and 11, comprise a two-stage simple relaxation CMOS (an acronym for Complimentary Metal Oxide Semiconductor) oscillator, well known in the art. In combination with external passive components, resistors 88, 89 and capacitor 90 connected to pins 8, 10, and 11 of ASIC 54, this oscillator creates out-of-phase square waves, switching nearly between VDD and VSS (circuit ground) levels, at pins 10 and 11 of ASIC 54. This voltage application to the piezoceramic disk causes it to flex back and forth along an axis perpendicular to the disk surface. The voltage from the feedback element, connected through resistor 88 to pin 8 of the ASIC 54, is used to synchronize the internal CMOS oscillator to the disk's natural resonant frequency. The disk's continuous bending back and forth, in conjunction with a resonant acoustic cavity closely coupled to the disk, produces the particular sound used for the audible alarm.

Figure 3:
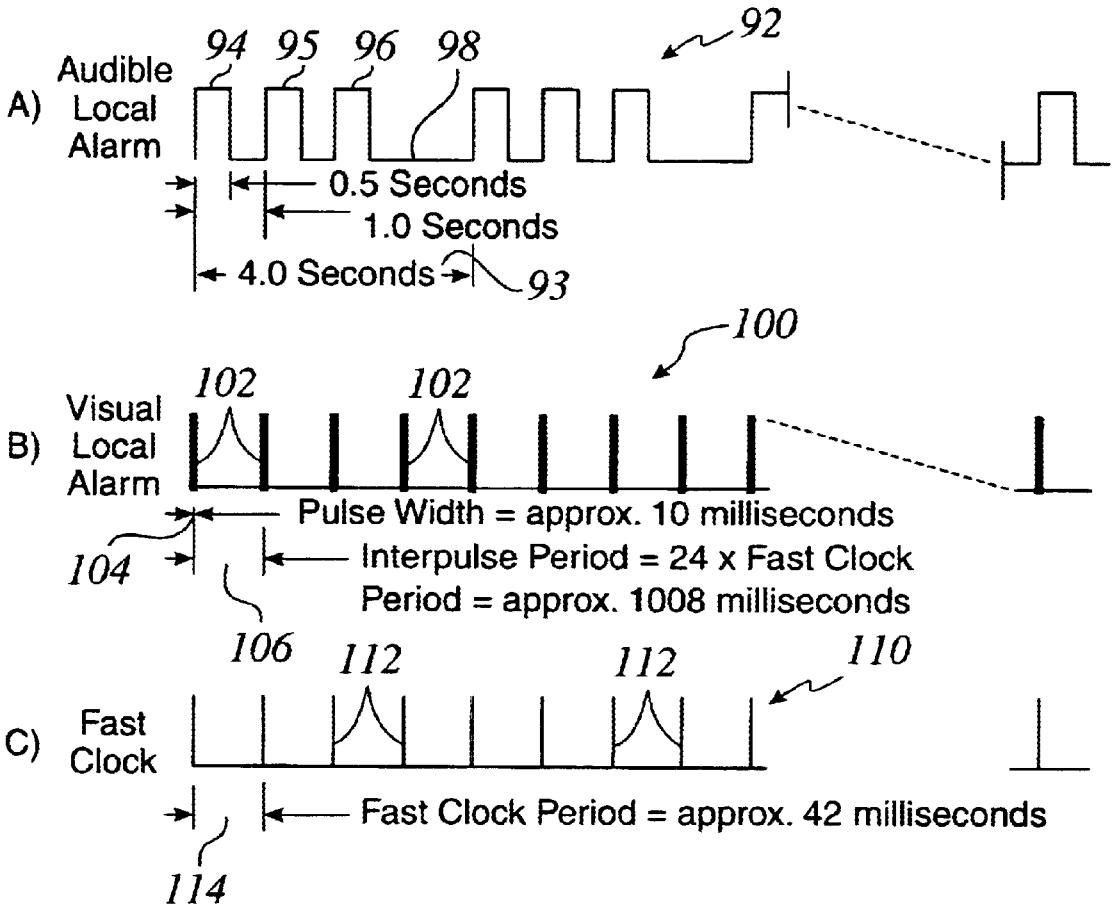
FIG. 3 Prior Art
FIG. 3, is an illustration of the actuation pattern waveforms of the prior art Underwriters Laboratories (UL217) standards for audible annunciation of a sensed alarm condition, as well as typical visual signals and the corresponding internal clock used in the description of the present invention.

When actuated, the piezoelectric horn provides an audible alarm comprising a fixed carrier frequency on the order of 3300 Hz, with an approximate minimum 85 decibel (dB) sound level (as required by all safety agencies), which is modulated in a temporal (time varying) pattern. In the illustrated smoke alarm embodiment the modulation pattern is that specified for an audible smoke alarm by Underwriters Laboratories UL 217 standard. This pattern, as shown in FIG. 3, illustration A), by the by waveform 92, has a nominal 4 second cycle 93, each cycle comprising three consecutive half second pulses 94–96, with a half second interpulse period, followed by an approximate 1.5 second pause 98. The audible effect is "tone-pause-tone-pause-tone-long pause."

As a result of the UL standard, this rhythmic audible sequence is generally, if not inherently, understood by the public to be associated with a dangerous smoke alarm condition. Similarly, although not shown here, the UL 217standard specifies a different, distinct audible temporal pattern for carbon monoxide detectors which consists of a nominal 5.0 second cycle of four 0.1 second pulses, with a 0.1 second interpulse period (total 0.7 seconds) followed by a pause of approximately 4.3 seconds. These distinct patterns are intended to immediately distinguish the subject state or nature of the sounded alarm to occupants, and with continuing use it is reasonably assumed that they may become well enough known to the public to provide subliminal warning of the danger they signify.

Simultaneously with audible annunciation of the local alarm condition, the sensor 20 provides visible annunciation by actuating the RED LED 38 in a different, visible temporal pattern. The visible local alarm annunciation pattern is shown by the waveform 100 in illustration B) of FIG. 3, as comprising a continuing series of pulses 102, having an approximate pulse width 104 of 10 milliseconds and an approximate interpulse period 106 of 1.0 second. This is the pattern of the gate signal applied by the logic circuitry 68 (FIG. 2) on line 66 to activate ("turn-on") the FET switch 64 and ground the LED 38. The LED is then pulsed on, powered by the battery 26, at the repetition frequency of the defined visual temporal pattern.

While the temporal patterns themselves are established by the logic circuitry 66, the timing control of the pulsed waveforms is governed by the ASIC oscillator and timing circuitry 108 of FIG. 2. The timing control circuitry 108 provides two clock signals, which are referred to here as a Fast Clock and a Slow Clock. The Fast Clock has a pulse repetition time of approximately 42 milliseconds, and the Slow Clock has a pulse repetition time which is approximately 40 times greater, or 40*42 ms=1.67 seconds. The Fast Clock provides the appropriate timing for the sensed alarm audible and visible temporal patterns 92, 100 (FIG. 3, illustrations A), B)). The Fast Clock signal is shown by waveform 110 of FIG. 3, illustration C). The clock pulses 112 have an interpulse period 114 of approximately 42 milliseconds.

Figure 6:
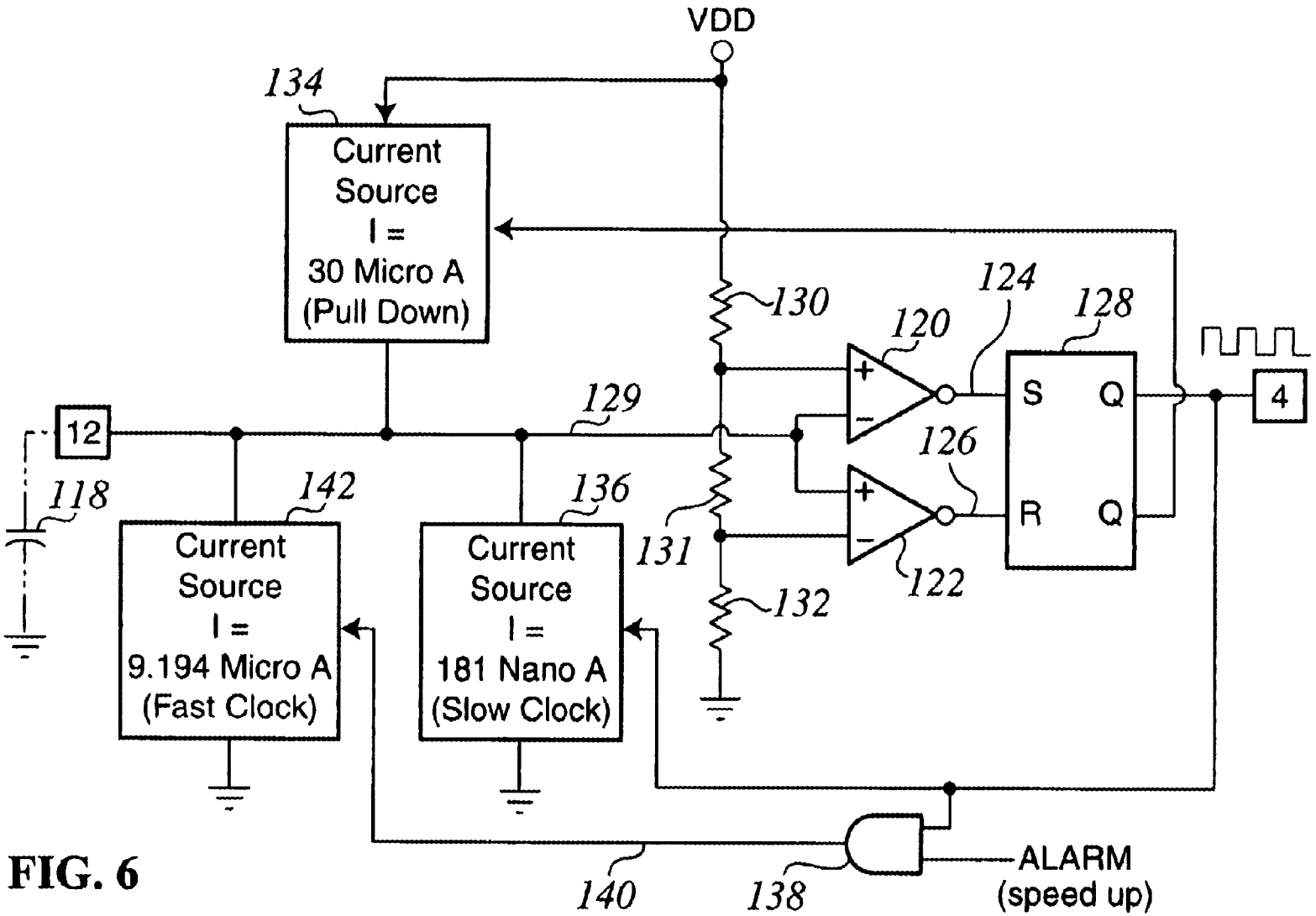
FIG. 6, is a simplified, representative schematic diagram of a portion of the element of FIG. 2.

Referring to FIGS. 1 and 2, the 1.67 second Slow Clock provides the base timing for the ionization smoker alarm's standby condition and it is controlled by a bias resistor 116 connected to pin 7 of the ASIC 54 and a timing capacitor 118 connected to the ASIC at pin 12. The programmable dual-rate timing circuitry portion of the logic circuitry 108 is shown for reference in highly simplified form as FIG. 6. Referring to FIG. 6, the timing portion includes comparators 120, 122 which provide their outputs on lines 124, 126 to the SET S and RESET R inputs of a bistable flip-flop 128. The inverting (–) input of comparator 120 and the non-inverting (+) input of comparator 122 are connected through line 129 to the external timing capacitor 118 at pin 12. The non-inverting (+) input of comparator 120 and the inverting input (–) of comparator 122 are connected to different points of a voltage divider network comprising series resistors 130–132.

In the absence of a sensed alarm condition, and beginning with an initial uncharged state for the capacitor 118, a first current source 134 charges the capacitor 118 with a relatively constant current value of approximately 30 micro amps. At initial conditions, a power-up reset circuit within ASIC 54 sets the bistable flip-flop such that the "Q" output is at a logic low (unasserted) and the "Q NOT" output is at a logic high (asserted). Additionally note that after the initial cycle, this charging current into capacitor 118 provides the approximately 10 ms phase of the master clock signal. The comparator 120 compares the increasing capacitor voltage to a first reference voltage equal to the sum voltage drop across resistors 131, 132, approximately ⅔ VDD. When the capacitor voltage magnitude exceeds that of the first reference voltage the comparator 120 changes states and shifts the bistable to the SET state, whereby the "Q" output is asserted and the "Q-not" output is unasserted.

During the standby phase of the ionization smoke alarm, or SLOW CLOCK mode, the SET state of the bistable flip-flop, or the state where the "Q" output is asserted, enables current sink 136 which, when actuated, provides the capacitor with a current sink of approximately 181 nano amps. As the capacitor 118 discharges over an approximate period of 1.66 seconds, the discharging capacitor voltage magnitude falls below that of a second reference voltage equal to the voltage drop across resistor 132, approximately ⅓ VDD. This causes the comparator 122 to change states and place the bistable in the RESET state, which disables the current sink 136 and simultaneously re-enables the current source 134. The capacitor voltage changes from approximately ⅓ VDD to approximately ⅔ VDD in 10 seconds. The charge and discharge process of capacitor 118 then repeats, causing a voltage waveform of a sawtooth to be generated at the ASIC 54 pin 12. The charging and discharging time constants, collectively, provide the approximate 1.67 second Slow Clock signal.

In response to a sensed alarm state signal provided by the detector 82 to the DETECT (pin 15) input of the ASIC, the alarm signal is logically ANDED with the Q output of the bistable 128 by gate 138 to provide a gate signal on line 140 to a second higher-value current source 142. The second source 142 provides a constant additional current sink of approximately 1.194 micro amps which, when added to the approximate 181 nano amps of the first source 134, provides a total discharging current of approximately 9.375 micro amps. This produces an approximate 32 millisecond discharging time constant which, together with the 10 second charge interval, provides the Fast Clock interpulse interval of approximately 42 milliseconds.

While the Fast Clock is required for timing the audible and visible alarm temporal patterns, the Slow Clock is used to provide the base timing signal for the non-alarm state, or standby, conditions. The alarm state condition is the highest priority state of the sensor alarm, and in reporting an alarm state the smoke alarm circuit is in a higher energy consumption state then it is under non-alarm conditions. This, of course, is the result of the need to sound both the audible alarm horn as well as the visible annunciation of the alarm state by illuminating the LED (38, FIG. 1). Energy consumption may not be a concern when the sensor is supplied solely with AC power, but in those instances where the AC power is interrupted and the smoke alarm must rely on its battery back-up, or for those smoke alarms which only have battery power, energy conservation is critical to the ensuring the performance integrity and battery life of the alarm.

The smoke alarm of the present invention achieves the energy conserving objectives under non-alarm state condition while providing full range of service performance features. These features include annunciation of each alarm origination by the sensor unit, so as to permit its identification from among a network of interconnected alarms. It also provides annunciation of a low battery condition to alert maintenance personnel and occupants of the need to change the battery.

These annunciations are provided in a pulsed, low power consumption protocol, which reduces the actuation duty cycle of the annunciator. The alarm origination annunciation is provided as a visual announcement only, but in a pulse coded protocol which emulates to a degree the UL standard protocol for the audible alarm provided for a dangerous condition. The present post-alarm origination visual annunciation protocol, therefore, is associative with the actual audible alarm protocol, just as the origination notice is functionally associative with detection of an actual smoke condition by the sensor. This association results in a notice which is more readily understood by the observer.

The benefit of this cannot be understated. Under circumstances where a combination of the published safety alarm standards, and proactive enhancements designed to improve the functionality of the smoke alarm to building occupants, requires the alarms to provide an increasing amount of state conditions, including: (i) annunciation of a detected dangerous condition within the alarm's monitored space, (ii) the broadcast annunciation of an alarm condition detected by another of a network of alarms, (iii) an alarm origination indication, and (iv) a low battery annunciation. The alarms must provide these announcements with a single audible and a single visible annunciator, and in a manner which readily distinguishes one state from another.

In addition, several states may exist in a given sensor at the same time. As an example, a sensor which originates an alarm annunciation must also provide an alarm origination notice, of which the second state may occur simultaneously with a low battery condition. Under the UL 217 standard the alarm annunciation of a detected dangerous condition takes priority over all other notices, however, the post-alarm origination notice state and the low battery state may well exist simultaneously. It is important, therefore, to provide distinct annunciation protocols which are distinguishable from each other and also apparent of the state they are announcing.

Figure 4:
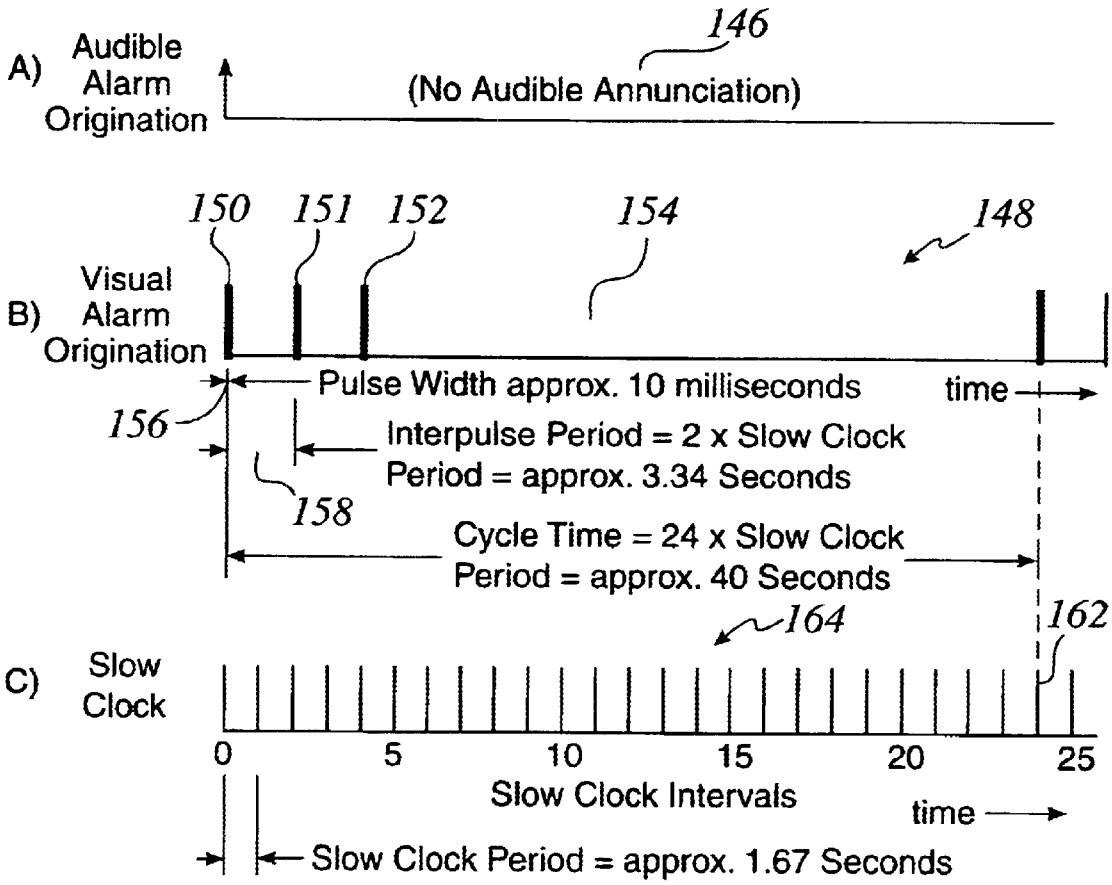
FIG. 4, is an illustration of the actuation pattern waveforms for visual annunciation of the sensed alarm origination according, as provided by the alarm sensor embodiment of FIG. 1.

The alarm origination annunciation protocol of the present invention is shown in FIG. 4, illustrations A) and B). It comprises a combination of zero audible annunciation (zero amplitude waveform 146 of illustration A)) and a pulsed visible annunciation pattern shown by the waveform 148 of illustration B). The visible annunciation protocol comprises three consecutive pulses 150–152, followed by a pause interval 154. The pulses 150–152 have a pulse width 156 of approximately 10 seconds, and an interpulse period 158 which is substantially equal to two Slow Clock Periods, or 2×1.67=3.34 seconds. The pattern repeats every 24 Slow Clock Periods, or approximately 40 seconds, as shown by the first pulse 160 of the next succeeding sequence occurring on the $24^{th}$ Period 162 of the Slow Clock Signal waveform 164 of illustration C).

As may be apparent, the visible alarm origination annunciation pattern is similar to the audible annunciation alarm sequence shown by the waveform 92 of FIG. 3, illustration A). As stated above, this similar sequence (pulse, pause, pulse, pause, pulse, long pause) associates the post-alarm visual origination pattern with the actual temporal audible alarm pattern to permit ready identification of the state condition by an observer. It is suggestive of an historical alarm incident. It is of course distinguishable from the actual alarm state by the fact that there is no accompanying audible annunciation.

The alarm origination annunciation is activated immediately following a smoke sensing condition. While smoke is being sensed, the local alarm provides both a visual warning, illustrated in waveform FIG. 3B), and an audible temporal warning, illustrated in waveform FIG. 3A). Upon termination of the local alarm condition, and assuming that no other smoke alarm on the interconnected network is also transmitting an alarm signal via the interconnect connection, the subject smoke alarm returns to the standby condition, whereby the SLOW CLOCK is operating. At this time, the audible horn is silent, illustrated in waveform FIG. 4A), but the visual warning signal, LED 58, blinks with the unique visual pattern illustrated in FIG. 4B). The post-alarm origination annunciation can be deactivated by an operator by depressing the "Push to Test" switch 166 (FIG. 1), which resets the logic of the post-alarm latch within the smoke alarm ASIC 54.

With regard to battery loading resulting from the use of the present annunciation format, with a 10 mA LED the alarm origination function consumes power at the approximate rate of 0.12 mA-hr per day. A typical carbon zinc battery has an approximate "rule-of-thumb" capacity of about 150 mA-hrs. This is the "base" battery smoke alarm manufacturers use for shipment, although batteries from various manufacturers have varying capacities in a non-discharged state. An alkaline battery chemistry, being about four to six times the cost, provides an approximate "rule-of-thumb" capacity of about 500 ma-hrs. Some smoke alarm product is sold with alkaline batteries. A premium lithium chemistry battery, costing approximately twenty times as much as a carbon zinc battery, provides an approximate "rule-of-thumb" capacity of about 1200 A-hrs.

To provide a comparison of the battery power consumption of the present duty cycled alarm origination annunciation with that provided by a constant illumination of the visible annunciatior (e.g. LED), assume a red LED 58 that is constantly illuminated in an alarm origination state, and a circuit that is calibrated by choice of resistor 56 value such that the current flow through the red LED 58 is approximately 10 mA. In 24 hours (one day), the consumption due to the red LED being steadily illuminated is 240 mA-hrs, which can exceed the total capacity of a carbon zinc battery. Thus, an alarm origination condition, if unnoticed by the occupant, can result in the low-battery signal being developed easily within one day of initiation.

The normal single "blink" of the red LED 58, shown in FIG. 3B), consumes approximately 22 mA-hr/yr of the batteries capacity. The alarm origination visual signal, shown in FIG. 4B), consumes an additional approximate 44 mA-hr/yr of battery capacity. Although it is unlikely that this signal may go unnoticed by the resident or occupant, it is a relatively moderate increase in the power drain presented to the battery during normal operation. For instance, in an AC/DC smoke alarm (the most popular smoke alarm being installed today), the normal power drain of the entire smoke alarm circuitry is supplied by the AC power supply. Only the periodic self-check of the battery capacity, occurring when the red LED 58 is energized once per minute, consumes the battery's energy. As mentioned earlier, the normal battery consumption may be approximately 22 mA-hr/yr, and the additional energy consumed by the alarm origination visual signal is about 44 mA-hr/yr, resulting in a total battery drain of about 66 mA-hr/yr. This increased consumption is well within the yearly energy supply of even the inexpensive carbon zinc battery, and thus will make an insignificant change in the perceived battery life. In fact, the carbon zinc battery is known to self-discharge in approximately two years, thus it is reasonable to expect that a normal battery life in a smoke alarm will be between one and two years, even in the low-power application of an AC/DC backup smoke alarm.

In a smoke alarm application whereby only DC smoke alarms are installed, or in the rarer condition whereby AC/DC smoke alarms may be operating without benefit of AC power for an extended period of time, the additional 44 mA-hr/yr consumption due to the post-alarm visual indicator is still a reasonable energy increase that will not substantially limit the life of the battery.

Finally, users are encouraged to test their alarms at a frequency of once per week by the owner's manual and engraving on the cover of the smoke alarms. The National Fire Protection Agency (NFPA), and of course, the media and fire protection officials, suggest that users test their smoke alarms at least once per month. This test, simply pressing and holding the "push-to-test" button on the cover of the smoke alarm, would reset the post-alarm latch condition whether or not the user noticed the specific visual pattern of the red LED 58. As a matter of information, a temporal audible alarm signal, energized for four seconds, and with a peak alarm current of approximately 15 mA, has an energy consumption of only 0.00625 mA-hrs. One "excuse" why residents do not test their alarms weekly is that they are concerned about "draining" the battery. However, the actual power drain due to a temporary alarm condition while testing is extremely insignificant compared to the normal background current of the circuit.

In addition to power consumption resulting from the duty cycle actuation of the visible annunciator, there is also the effectiveness of the signaling protocol. It is well known that human stimulus is enhanced by variation. A steadily illuminated LED will not command the attention that would be obtained by a flashing LED. Human senses respond better to modulated signals—consider, for example, a police car or fire truck with steadily illuminated lights and a constant tone siren. These do not exist, simply because flashing lights and modulated sirens will much better notify people that a dangerous condition exists. In an identical manner, the flashing LED showing post-alarm condition, or the flashing LED that would aid in recognition of the particular unit with a low-battery condition, is much more effectively communicated than a steady state signal for either condition, as well as providing an enhanced battery life for the unit.

Finally, the use of a three-flash pattern for post alarm condition is designed to function as a mnemonic for the user, in that users will be accustomed to a pattern of three audible tones indicate a smoke condition. Certainly any pattern could have been used, but the author feels the best pattern is one that minimizes additional battery drain and that effectively communicates the idea of a "alarm condition",albeit one in the smoke alarm's past history, to the user. This signal is the combination of three flashes and a period of inactivity, as illustrated many times within the previous paragraphs.

Figure 5:
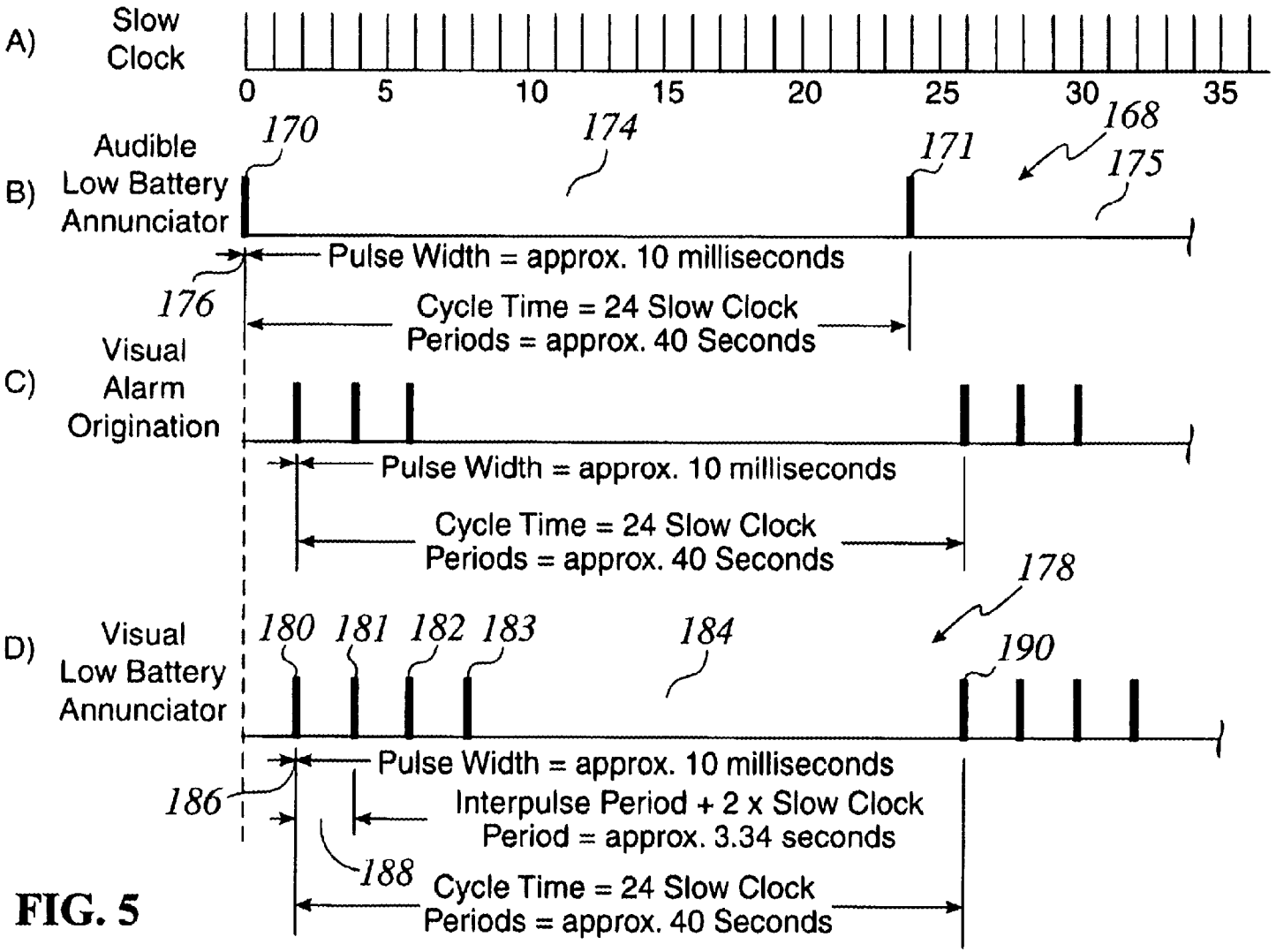
FIG. 5, is an illustration of the actuation pattern waveforms for audible and visual annunciation of a post-alarm condition (FIG. D.) and low battery condition (FIGS. B. & C.), as provided by the embodiment of FIG. 1.

When a low battery condition is detected by the ASIC (54, FIG. 1), the low battery annunciation protocol may be initiated, but it cannot be activated in the presence of either an actual alarm annunciation, or might be confusing if activated during an alarm origination annunciation. Among the different sensor states, the low battery condition has the lowest priority. Absent the existence of a higher priority state, and in the presence of a low battery condition, the ASIC logic circuitry (68, FIG. 1) actuates the low battery annunciation with a combination audible and visible protocol shown in illustrations B) and D). The visible annunciation pattern is similar to, but distinguishable from, the alarm origination pattern which is again illustrated in FIG. 5, illustration C) for the convenience of comparing the two. Similarly, for convenience, illustration A) shows the Slow Clock signal.

The audible annunciation of the low battery state comprises a single pulse (audible "horn chirp") which occurs every 24 Slow Clock Periods, or approximately every 40 seconds. This is shown in illustration FIG. 5 illustration B) by the waveform 168, with individual pulses 170, 171 occurring in consecutive cycles 174, 175. The pulses 170, 171 have an approximate 10 millisecond pulse width 176.

The simultaneous visible annunciation of post-alarm and low battery condition is a pulsed pattern shown by the waveform 178 of illustration D). The visible annunciation protocol comprises four consecutive pulses 180–183, followed by a pause interval 184. The pulses 180–183 have a pulse width 186 of approximately 10 seconds, and an interpulse period 188 which is substantially equal to two Slow Clock Periods, or 2×1.67=3.34 seconds. The pattern repeats every 24 Slow Clock Periods, or approximately 40 seconds, as shown by the first pulse 190.

The present sensor alarm is capable of both standalone operation in detecting and annunciating a dangerous condition within its owns monitored space, as well network operation in which it is connected with other alarms to provide "broadcast" annunciation of an alarm condition detected in any one or more of the interconnected sensors. In FIG. 1, the input/output (I/O) pin 2 of the ASIC 54 provides the sensor's interface connection to the other sensors. The I/O is connected through line 192 to the other networked sensor alarm units 194–197, which are shown symbolically as UNIT B–UNIT E. The line 192 includes a low pass filter comprising the series resistor 198 and shunt capacitor 200. A zener diode 202 provides suppression for the interconnecting line transients.

Although the invention has been shown and described with respect to a best mode embodiment thereof, it should be understood by those skilled in the art that various changes, omissions, and additions may be made to the form and detail of the disclosed embodiment without departing from the spirit and scope of the invention, as recited in the following claims.

I claim:

1. A sensor alarm, for annunciating an alarm condition in response to its detection of a dangerous condition within its installed space, comprising:

sensor means, for detecting the presence of a dangerous condition and for providing an alarm signal in response thereto; and alarm means, including an audible annunciator and a visible annunciator, and including logic circuitry having an alarm signal protocol which, in response to the presence of said alarm signal, actuates said audible annunciator and said visible annunciator to provide a combination audible and visible alarm annunciation of the dangerous condition during an alarm interval;

as characterized by:

said logic circuitry further including an alarm origination signal protocol for providing, in response to the antecedent presence of said alarm signal, and at the conclusion of said alarm interval, pulsed excitation of said visible annunciator to provide an encoded visible annunciation of the sensor alarm as the originating source of the alarm annunciation.

2. The alarm sensor of claim 1, wherein said alarm protocol actuates said audible annunciator in a fixed, audibly rhythmic pattern, in each of a plurality of succeeding cycles within the alarm interval.

3. The alarm sensor of claim 2, wherein said fixed, audibly rhythmic pattern is representative of the audible annunciation identified for smoke alarm conditions by Underwriters Laboratories standard UL 217.

4. The alarm sensor of claim 2, wherein said alarm origination signal protocol provides said encoded visible alarm origination annunciation as periodically varying illumination of said visible annunciator in a manner which emulates the fixed, audibly rhythmic pattern of the audible annunciation of said alarm condition, to provide to an observer an associative identification of said visible alarm origination annunciation with said audible alarm annunciation.

5. The alarm sensor of claim 4, wherein said visible alarm origination annunciation comprises a fixed, visually rhythmic pattern of pulsed illumination, in each of succeeding cycles within the alarm interval, said visually rhythmic pattern comprising three pulses of illumination within each said cycle.

6. The alarm sensor of claim 5, wherein said three pulses of illumination occur within the first half of the time period of each said cycle.

7. The alarm sensor of claim 2, wherein said alarm origination signal protocol provides said encoded visible alarm origination annunciation while inhibiting actuation of said audible annunciator.

8. The alarm sensor of claim 3, wherein said alarm origination signal protocol provides said encoded visible alarm origination annunciation as a periodically varying illumination of said visible annunciator in a manner which emulates the UL 217 standard for the audible alarm annunciation.

9. The alarm sensor of claim 5, wherein said visible annunciator is a light emitting diode.

10. The alarm sensor of claim 1, further comprising:

a battery;

battery monitoring circuitry detecting the presence of a low battery voltage condition and for providing a low battery signal in response thereto;

and wherein said logic circuitry further includes a low battery annunciation signal protocol which, in response to the presence of a low battery signal in the absence, both individually and jointly, of an alarm annunciation and an alarm origination annunciation, actuates said audible annunciator and said visible annunciator, jointly, to provide an encoded combination of audible and visible annunciation of a low battery condition.

11. The sensor of claim 10, wherein said encoded combination of audible and visible annunciation comprise a pulse encoded audible low battery annunciation and a pulse encoded visible low battery annunciation.

12. The sensor of claim 10, wherein said pulse encoded audible low battery annunciation and said pulse encoded visible low battery annunciation each comprise periodically repeating patterns of pulses.

13. The sensor of claim 12, wherein said pulse encoded audible annunciator comprises a horn.

14. The sensor of claim 13, wherein the periodically repeating pattern of said encoded audible annunciation comprises an emitted horn chirp.

15. The alarm sensor of claim 12, wherein said pulse encoded visible low battery annunciation comprises a fixed, visually rhythmic pattern of pulsed illumination, in each of succeeding cycles within the alarm interval.

16. The alarm sensor of claim 12, wherein said visually rhythmic pattern comprises three pulses of illumination within each said cycle.

17. The alarm sensor of claim 16, wherein said three pulses of illumination occur within the first half of the time period of each said cycle.

18. A sensor alarm, of the type which originates annunciation of an alarm in response to its detection of a dangerous condition within its monitored space, and which also annunciates an alarm originated by an external sensor alarm to which it is connected for response, comprising:

sensor means, for detecting the presence of a dangerous condition and for providing a monitored space alarm signal in response thereto;

interconnect means, for receiving external sensor alarm signals from external sensor alarms connected thereto; and alarm means, including an audible annunciator and a visible annunciator, and including logic circuitry having an alarm signal protocol which, in response to the presence, both individually and jointly, of said monitored space alarm signal and said external sensor alarm signal, actuates said audible annunciator and said visible annunciator, jointly, to provide audible and visible alarm annunciation of the dangerous condition during an alarm interval;

as characterized by:

said logic circuitry further including an alarm origination signal protocol for providing, in response to the antecedent presence of said monitored space alarm signal, and at the conclusion of said alarm interval, pulsed excitation of said visible annunciator to provide an encoded visible annunciation of the sensor alarm as the originating source of the alarm annunciation.

19. The alarm sensor of claim 18, wherein said alarm protocol actuates said audible annunciator in a fixed, audibly rhythmic pattern, in each of a plurality of succeeding cycles within the alarm interval.

20. The alarm sensor of claim 19, wherein said fixed, audibly rhythmic pattern is representative of the audible annunciation identified for smoke alarm conditions by Underwriters Laboratories standard UL 217.

21. The alarm sensor of claim 19, wherein said alarm origination signal protocol provides said encoded visible alarm origination annunciation as periodically varying illumination of said visible annunciator in a manner which emulates the fixed, audibly rhythmic pattern of the audible annunciation of said alarm condition, to provide to an observer an associative identification of said visible alarm origination annunciation with said audible alarm annunciation.

22. The alarm sensor of claim 21, wherein said visible alarm origination annunciation comprises a fixed, visually rhythmic pattern of pulsed illumination, in each of succeeding cycles within the alarm interval.

23. The alarm sensor of claim 21, wherein said visually rhythmic pattern comprising three pulses of illumination within each said cycle.

24. The alarm sensor of claim 23, wherein said three pulses of illumination occur within the first half of the time period of each said cycle.

25. The alarm sensor of claim 19, wherein said alarm origination signal protocol provides said encoded visible alarm origination annunciation while inhibiting actuation of said audible annunciator.

26. The alarm sensor of claim 20, wherein said alarm origination signal protocol provides said encoded visible alarm origination annunciation as a periodically varying illumination of said visible annunciator in a manner which emulates the UL 217 standard for the audible alarm annunciation.

27. The alarm sensor of claim 22, wherein said visible annunciator is a light emitting diode.

28. The alarm sensor of claim 18, further comprising:

a battery;

battery monitoring circuitry detecting the presence of a low battery voltage condition and for providing a low battery signal in response thereto;

and wherein said logic circuitry further includes a low battery annunciation signal protocol which, in response to the presence of a low battery signal in the absence, both individually and jointly, of an alarm annunciation and an alarm origination annunciation, actuates said audible annunciator and said visible annunciator, jointly, to provide an encoded combination of audible and visible annunciation of a low battery condition.

29. The sensor of claim 28, wherein said encoded combination of audible and visible annunciation comprise a pulse encoded audible low battery annunciation and a pulse encoded visible low battery annunciation.

30. The sensor of claim 28, wherein said pulse encoded audible low battery annunciation and said pulse encoded visible low battery annunciation each comprise periodically repeating patterns of pulses.

31. The sensor of claim 29, wherein said pulse encoded audible annunciator comprises a horn.

32. The sensor of claim 30, wherein the periodically repeating pattern of said encoded audible annunciation comprises an emitted horn signal.

33. The alarm sensor of claim 28, wherein said pulse encoded visible low battery annunciation comprises a fixed, visually rhythmic pattern of pulsed illumination, in each of succeeding cycles within the alarm interval.

34. The alarm sensor of claim 33, said visually rhythmic pattern comprising four pulses of illumination within each said cycle.

35. The alarm sensor of claim 34, wherein said four pulses of illumination occur within the first half of the time period of each said cycle.

* * * * *